United States Patent [19]

Gandara

[11] 4,109,984

[45] Aug. 29, 1978

[54] WALK-IN COOLER CONSTRUCTION

[76] Inventor: Nemesio N. Gandara, El Paso, Tex.

[21] Appl. No.: 754,882

[22] Filed: Dec. 27, 1976

[51] Int. Cl.[2] ..... H01J 1/00

[52] U.S. Cl. ..... 312/236; 312/116; 211/49 D

[58] Field of Search ..... 312/116, 236, 214, 250, 312/60, 61, 72; 211/49 D; 52/246; 62/266

[56] References Cited

U.S. PATENT DOCUMENTS

| | | | |
|---|---|---|---|
| 951,323 | 3/1910 | Mathewson | 211/49 D |
| 1,179,831 | 4/1916 | Hess | 312/116 |
| 1,626,935 | 5/1927 | Holderle et al. | 312/236 |
| 2,039,684 | 5/1936 | Dudley | 312/236 |
| 2,134,644 | 10/1938 | Sadler | 312/116 |
| 2,218,444 | 10/1940 | Vineyard | 211/49 D |
| 2,294,119 | 8/1942 | Leary | 312/116 |
| 2,315,515 | 4/1943 | Gibson et al. | 211/49 D |
| 2,601,634 | 6/1952 | Rivette | 312/236 |
| 2,779,169 | 1/1957 | Sharpe et al. | 211/49 D |
| 2,901,118 | 8/1959 | Beesley | 211/49 D |

FOREIGN PATENT DOCUMENTS

| | | | |
|---|---|---|---|
| 532,735 | 8/1931 | Fed. Rep. of Germany | 211/49 D |

*Primary Examiner*—Paul R. Gilliam
*Assistant Examiner*—Victor N. Sakran
*Attorney, Agent, or Firm*—Clarence A. O'Brien; Harvey B. Jacobson

[57] ABSTRACT

A walk-in cooler construction designed to be built into a corner of a room which is complete in and of itself together with hydroplaster walls, fiberglass and urethane insulation throughout, and at least one insulated entrance door. The cooler is complete with refrigeration unit of sufficient cooling capacity to keep the entire inside thereof at a desired low operating temperature. Provision is made to have a plurality of beverage can-supporting racks mounted adjacent multiple access doors for permitting a large number of cans of beer and the like to be kept at sufficiently cool temperture ready for immediate dispension and drinking thereof. A structure is also provided for supporting a plurality of draft beer kegs together with appropriate dispensing means therefor. Lighting structure, shelf and drain structure also are provided. Several modifications of the dispensing rack structure are also included.

4 Claims, 9 Drawing Figures

12
14
10
16
18
20
28
30
32
34
36
38
40
41
42
43
44
100

WALK-IN COOLER CONSTRUCTION

BACKGROUND OF THE INVENTION

1. Field of the Invention

This invention relates generally to devices for maintaining liquid beverages in cans and kegs at appropriate cooled drinking temperatures as well as providing means for storing and dispensing large quantities of said beverages.

2. Description of the Prior Art

A common problem with known type devices for dispensing cool beverages is that the structure is not adequate in size to contain large quantities of the beverage units. Furthermore, such known type devices are flexible in arrangement and operation.

Another problem with known type devices for cooling canned and bottled goods is that the structures are not of the walk-in type, and do not permit an operator and user of the device the necessary cooling and storage capacity for large operations.

Another problem with known type cooling structures is that they do not offer sufficient built-in features to enable the operator of the device to provide self-service features to the clientele in the desired efficient manner.

Another problem with known type devices is that they are not sufficiently insulated and well constructed to have low energy requirements, and desirable efficiency and conservation in the use of energy. They thus are relatively expensive and costly to operate in addition to oftentimes being complicated.

Known prior art patents which may be pertinent to this invention are as follows: U.S. Pat. Nos: 224,383, H. Bruggen, Feb. 10, 1880; 1,004,998, L. J. Crecelius, Oct. 3, 1911; 1,264,180, J. T. Harris, Apr. 30, 1918; 2,134,644, H. E. Sadler, Oct. 25, 1938; 3,379,294, W. J. Van Liew, Jr., Apr. 23, 1968.

None of these known prior art devices offers the new and unique features of the invention disclosed herein.

SUMMARY OF THE INVENTION

An object of the present invention is to provide a walk-in cooler construction which is efficient and conservative in the use of energy used to keep the inside temperature of the cooler at the desired low temperature.

Another object of the present invention is to provide a walk-in cooler construction which is flexible in operation and will provide for the dispensing of both canned beverages as well as beverages stored in kegs. A self-service feature is an important part of this arrangement.

A further object of this invention is to provide a walk-in cooler construction having thick insulated walls together with hydroplaster inside surfaces, and a plurality of dispensing racks together with individual access doors thereto for permitting customers of the user/operator of the device self-service access to the cooled canned beverages stored therewithin.

A still further object of this invention is to provide a walk-in cooler construction having appropriate lighting devices together with shelves and drain structures for permitting an attractive display of the beverages available from the cooler unit together with quick and yet clean dispensing thereof.

Another further additional object of this invention is to provide flexible and adjustable rack structure for dispensing of canned beverages together with relatively fail-proof self-service construction.

The walk-in cooler construction of this invention offers a number of new and unique features. It is designed to be built into a corner of an existing room, or at least along one wall of an existing building. Additional insulation is applied over a tar treatment as applied to the existing walls together with urethane as well as cork and fiberglass insulation. All the walls of the walk-in cooler are designed to be moisture and humidity resistant and have an inside surface of hydroplaster. A self-contained refrigeration unit is provided for maintaining the entire enclosure of the cooler at the appropriately desired low operating temperature. A walk-in door is provided in at least one end of said structure and appropriate interior lighting is also provided. At least a two-inch concrete floor is added to the interior of the cooler over the existing floor, after appropriate waterproof treatment thereof. Also, by using the same wall construction on all four walls, a walk-in cooler can be built as a room in itself.

Within the walk-in cooler storage racks are provided for kegs of draft beer and the like together with a plurality of racks for dispensing canned or bottled beverages in a self-service manner. These racks are made, of either stainless steel construction or of individual welded rod construction and are built as individual units to add overall flexibility to the cooler arrangement. The racks normally are positioned adjacent a plurality of access doors along the front wall of the cooler to permit self-service operation of the cooler. That is, customers may help themselves to the canned beverages by opening one or more of the access doors associated with the dispenser racks, and remove the desired number of cans therefrom. The racks are so designed that as soon as one canned beverage is removed, another canned beverage moves into place to replace same. In addition to the canned beverage dispensers, keg beverage dispensing means is also provided together with the appropriate hookup for the kegs contained within the cooler. In addition to the dispensing structure for the kegs of draft beer and the like, a stainless steel drain is mounted at the front of the device directly below the draft beer dispensing structure to catch any spillage or drippings. This is important to aid in the efficiency and cleanliness of the overall structure. Appropriate lighting also is provided along the upper portion of the front to adequately light the structure, shelves, access doors, and draft beverage dispensing apparatus.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2:
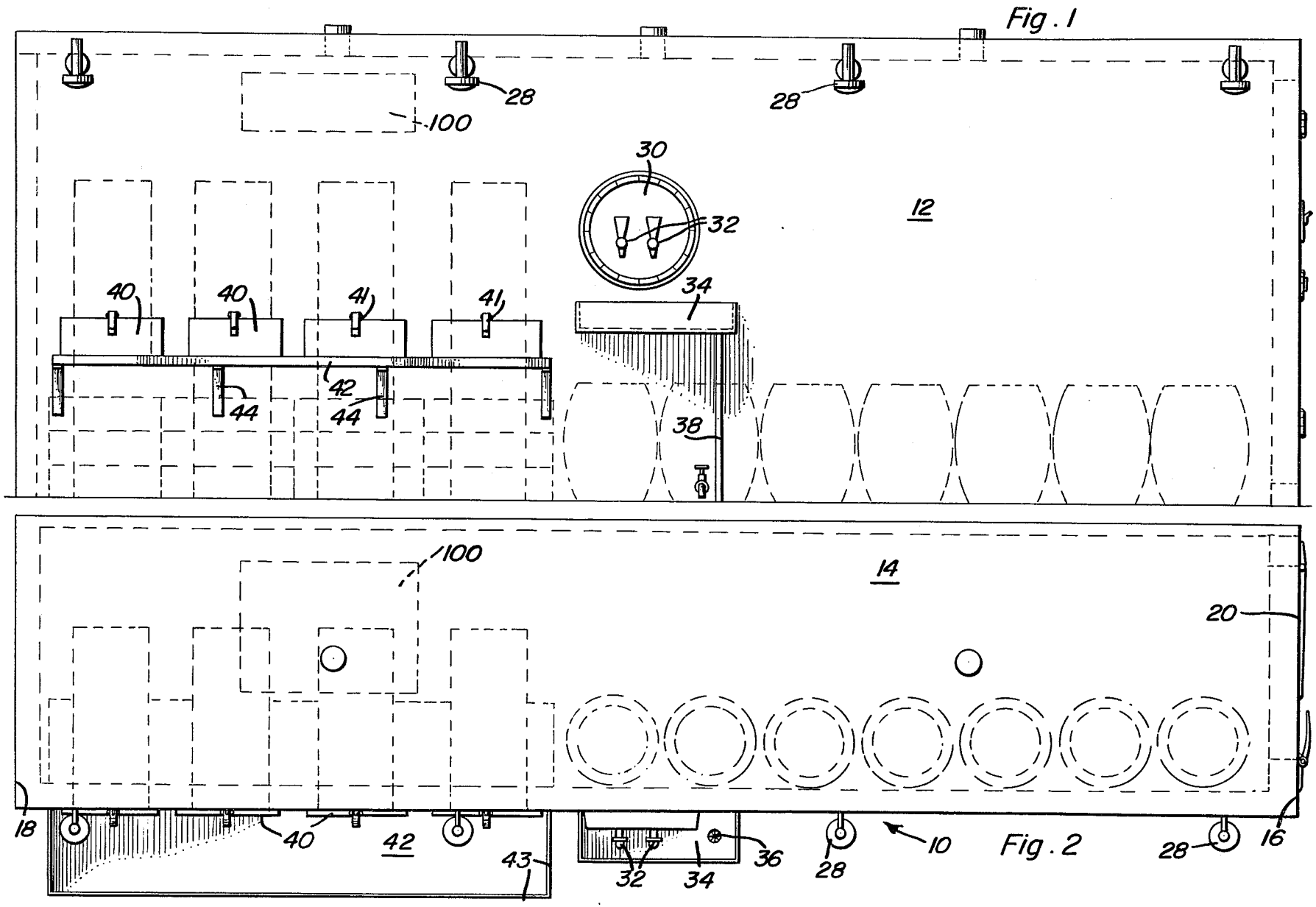
FIG. 1 is a front elevational view of the device of this invention.
FIG. 2 is a top plan view of the device of this invention.

Referring to FIG. 2 of the drawings, reference numeral 10 indicates the walk-in cooler construction of this invention. Looking at FIGS. 1, 2 and 4, the overall construction of the cooler will be described in detail. An attractive decorated panel 12 is provided on the front of the walk-in cooler. The cooler is preferably constructed on a preexisting floor 13 of concrete or the like and consists of a top ceiling 14 and a new floor 15. The wall and ceiling framing may be of conventional 2×4 construction spaced on 16- or 24-inch centers. In actual practice 24-inch centers have been found to be adequate.

Figure 3:
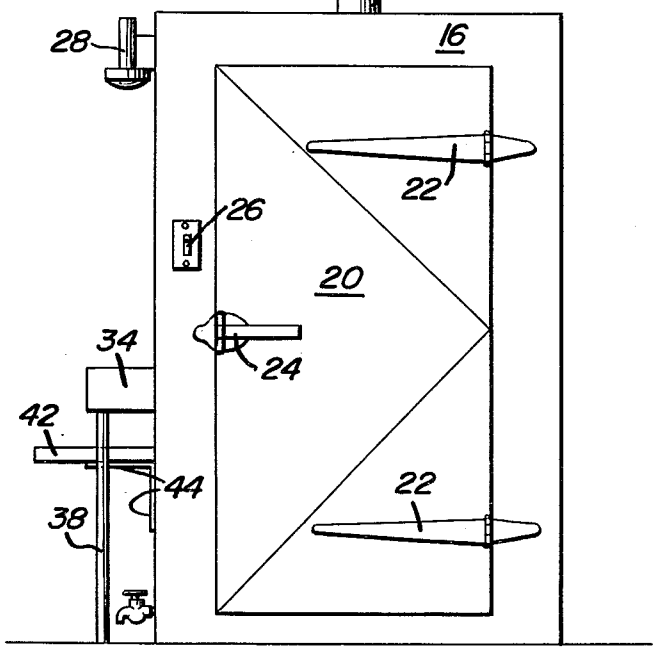
FIG. 3 is an end view looking from the right of FIGS. 1 and 2.

As seen in FIG. 3, at least one end wall 16 has an appropriate access door 20 provided therein supported by hinges 22 with a latch 24 with inside release handle provided therewith. A light switch 26 is normally also provided for actuation of the lights 28 mounted externally on the front of the cooler, as well as lights 28' inside of said cooler. Separate switches may also be provided for the different lights.

A keg beer dispenser apparatus 30 with dispensing spouts 32 is appropriately mounted mid-way of the front of the cooler with a catch drain 34 and discharge line 38 for catching and draining away any spillage of the keg beer as dispensed through the spouts 32. A drain 36, best seen in FIG. 2, also commonly would be provided. The keg beer normally is stored within the cooler as indicated by the dotted lines in FIGS. 1 and 2. Only one row is shown in these views, but normally additional rows would be provided stacked upon the lower kegs, or appropriately supported by additional shelves, not shown, which may be installed within the cooler. Access doors 40 for canned beer and other beverages are provided to the left of the keg beer dispenser. An appropriate shelf 42 of stainless steel or the like is mounted immediately below the row of access doors for permitting a user of the device to stack the canned or bottled beverages as removed from the access doors. Each access door 40 is appropriately provided with a latch-type handle 41 for positively securing said doors in closed position and yet permitting easy opening when desired. Right angle support members 44 normally mount the shelf 42 to the front of the cooler.

Figure 5:
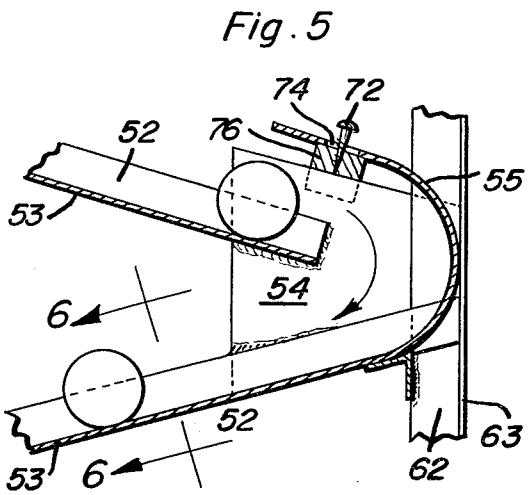
FIG. 5 is an enlarged detail of a fragmentary portion of the dispenser rack structure.
Figure 6:
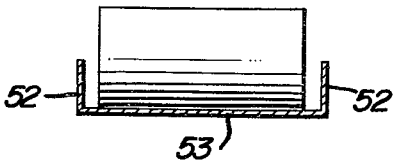
FIG. 6 is a cross-sectional view taken generally along line 6—6 of FIG. 5.
Figure 4:
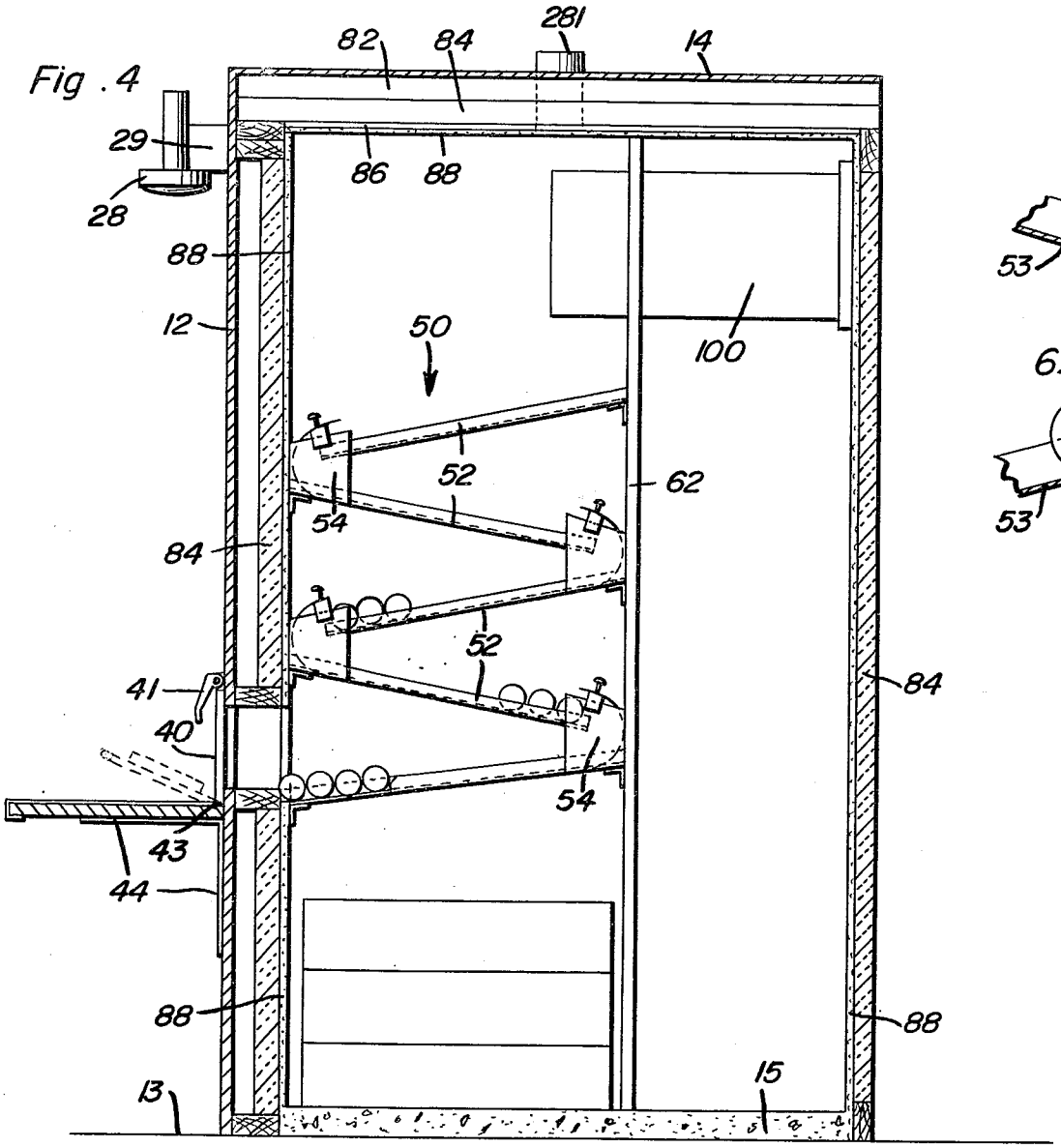
FIG. 4 is an end elevational view, partly in cross section, taken along the mid-section of the leftmost portion of FIGS. 1 and 2.

Reference numeral 50 in FIG. 4 indicates in general a beverage can dispensing rack as designed for use with the cooler. FIGS. 5 and 6 show cross-sectional and fragmentary portions of the dispenser structure. Side rails 52 together with a bottom portion 53 of appropriate width for the size cans to be dispensed are provided with connectors 54 at the ends thereof for reversing the flow of the containers as they pass through the dispenser. Main support members 62 of angle iron type construction support at least one set of ends of the dispenser structure, and preferably both ends thereof. As shown in FIG. 4, the front ends of the dispenser tracks 52, 53 are attached to the inner wall of the cooler while only the rear or innermost ends are mounted from the angle iron support 62, 63. However, the invention envisions having both ends mounted from such angle iron supports, similar to the embodiment of FIG. 7, so that the dispenser rack may be moved laterally within the cooler as necessary for proper spacing of the dispenser units in relationship to the access doors 40, or to permit complete removal thereof for other purposes. The plate members 54, as seen in FIG. 5, are appropriately attached by welding or the like to the associated ends of the tracks 52, 53. A curved member 55 is adjustably supported on the flange portion 76 by the apertures 74 and the adjusting screw 72.

Figure 8:
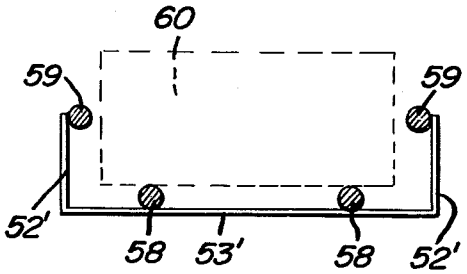
FIG. 8 is a cross-sectional view taken generally along line 8—8 of FIG. 7.
Figure 9:
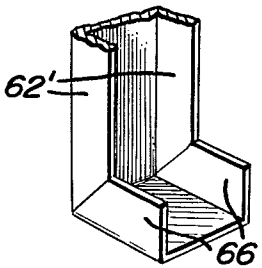
FIG. 9 is a fragmentary portion of the lower rack frame of the FIG. 7 embodiment.
Figure 7:
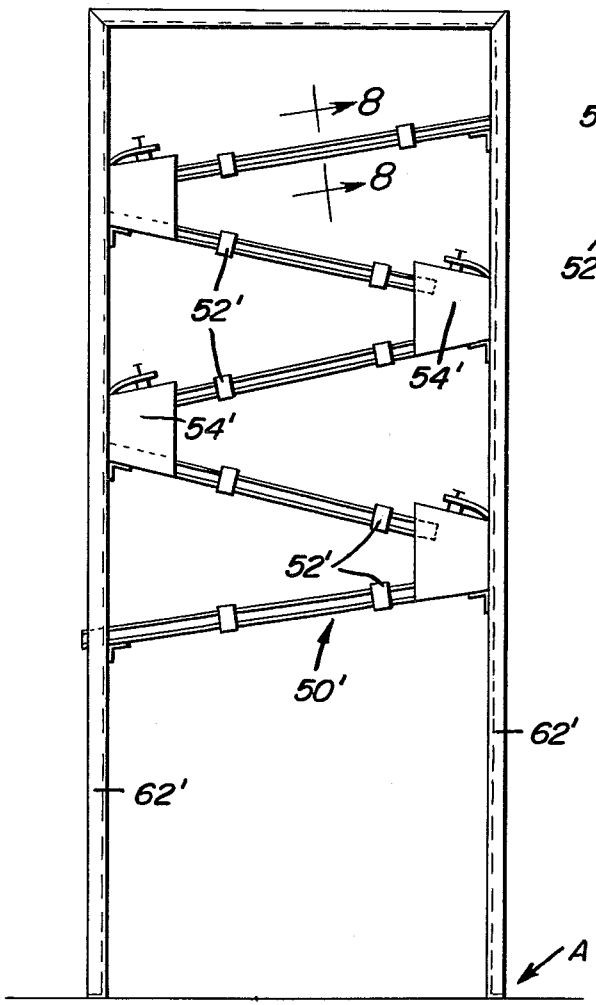
FIG. 7 is an alternate embodiment of the dispenser rack construction.

FIGS. 7–9 show another embodiment of the beverage container dispenser rack wherein side members 52' and bottom members 53' consist of short metal strip portions appropriately welded to rods 58 for forming the bottom of the channel and rods 59 or the sides of said channel. Adjustable end structures 54' are also mounted upon the angle iron supports 62'. These supports 62' may be of light metal channel or single angle construction, as best seen in FIG. 9. A right angle extending bottom portion 66 may be provided to form feet for the dispenser structure.

Looking at FIG. 4, the overall cooler, as set forth above, preferably is constructed of conventional type 2×4 framing and completely insulated with urethane or other type insulation 84 on the back, front and side walls as well as the ceiling. Also, it has been found very desirable to use hydroplaster coating on the inside surface of the cooler as indicated by reference numeral 88. Reference numeral 86 on the ceiling of the cooler indicates wire mesh on ½ inch treated plywood for retention of the 1- inch thick hydroplaster 88. Similar mesh may be used on the walls also though not shown. Reference 82 indicates cork insulation used on the ceiling in addition to the urethane insulation for substantially increasing the energy conservation of the overall cooler construction. Normally, wherever the back wall, or other walls of the cooler mount against existing building walls, the existing walls will be tar treated prior to the installation of the cooler. This is for the purpose of preventing condensate or liquid transmission through the cooler into the building walls and possible damage thereof. An appropriate refrigeration unit of conventional type 100 is normally provided of sufficient size to adequately keep the entire inside of the cooler at a suitable low temperature for the stored beverages. Preferably, all of the racks, dispensers, trays, shelves, etc. are of rust resistant material such as stainless steel to prevent any rusting of such metal structures. Appropriate electrical outlets and additional lights may be provided within or associated with the cooler as deemed necessary by the user of same.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a walk-in refrigerator having insulated walls, at least one of the walls having entry door therein for entry into the interior of the refrigerator, the improvement comprising:

at least one access door provided in a wall of the refrigerator, the access door being operable from exteriorly of the refrigerator; and, dispensing means for storing and sequentially dispensing cans maintained within the refrigerator, the cans being dispensed through the access door on opening of said access door, the dispensing means comprising a plurality of at least partially enclosed guide members having curved surfaces on which the cans are adapted to roll, support members to which the ends of the guide members are mounted, and direction-reversing means for guiding the cans from an upper guide member onto a lower guide member at adjacent ends of said guide members, said guide members comprising adjusting means at the respective ends of said guide members for adjusting the flow of cans therethrough, the direction-reversing means being mounted to the adjacent ends of said guide members and to one of the support members, the dispensing means having an exit end formed of the lowermost end of the lowermost guide member, the exit end being located adjacent the opening in the wall of the refrigerator covered by the access door whereby cans are dispensed through said access door.

2. In the apparatus of claim 1 wherein the support members comprise spaced interconnected rail members detachably mountable within the refrigerator to at least portions of the walls thereof, the rail members mounting the guide members and being movable within or from the refrigerator.

3. In the apparatus of claim 1 wherein the improvement further comprises support means for holding in storage kegs of fluent material and service means for holding at least one keg within the refrigerator and having a dispenser extending through a wall of the refrigerator for dispensing the fluent material from the keg on actuation thereof from a location externally of the refrigerator.

4. In the apparatus of claim 1 wherein the direction-reversing means comprise:

a plate member attached to spaced adjacent ends of the guide members, and to the support member adjacent said adjacent ends of said guide members;

an arcuate member mounted between the adjacent ends of the guide members and defining a curved surface on which the cans roll from the uppermost guide member of said guide members to the lowermost guide member of said guide member to form a path along which said cans travel, the direction of travel of the cans being substantially reversed at said adjacent ends; and, means for mounting the arcuate member to the plate member.

* * * * *

UNITED STATES PATENT OFFICE

CERTIFICATE OF CORRECTION

PATENT NO. : 4,109,984

DATED : August 29, 1978

INVENTOR(S) : Nemesio N. Gandara

It is certified that error appears in the above-identified patent and that said Letters Patent are hereby corrected as shown below:

In the heading, delete the words following "Nemesio N. Gandara", and substitute therefor --1218 Texas Street, El Paso, Texas 79901--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*